United States Patent [19]

Ross

[11] 3,972,115

[45] Aug. 3, 1976

[54] SAFETY RAZORS

[75] Inventor: Michael F. Ross, Whitley Bay, England

[73] Assignee: Wilkinson Sword Limited, Great Britain

[22] Filed: May 22, 1974

[21] Appl. No.: 472,186

[30] Foreign Application Priority Data

May 24, 1973 United Kingdom ..... 24927/73
June 13, 1973 United Kingdom ..... 28046/73

[52] U.S. Cl. ..... 30/59
[51] Int. Cl.[2] ..... B26B 21/32
[58] Field of Search ..... 30/58, 59, 60, 61, 66, 30/75, 84

[56] References Cited

UNITED STATES PATENTS

| | | | |
|---|---|---|---|
| 1,888,747 | 11/1932 | Swan | 30/60 |
| 2,145,860 | 2/1939 | Carlson | 30/60 |
| 2,582,041 | 1/1952 | Kaplan | 30/59 |
| 3,154,852 | 11/1964 | Westlake | 30/75 X |
| 3,650,027 | 3/1972 | Stephenson | 30/58 |
| 3,667,121 | 6/1972 | Dorion | 30/60 |
| 3,680,211 | 8/1972 | Keck | 30/75 |

*Primary Examiner*—Al Lawrence Smith
*Assistant Examiner*—Gary L. Smith
*Attorney, Agent, or Firm*—Leydig, Voit, Osann, Mayer & Holt, Ltd.

[57] ABSTRACT

The invention provides a safety razor comprising a handle, a guard bar adapted to receive a razor blade thereon, and a top cap linked to the guard bar and manually movable into a position in which a razor blade can be trapped between the top cap and the guard bar. A catch secures the top cap on the guard bar, the said catch having a first component on the top cap and a second component which engages with the handle, the first and second components being brought into engagement when the top cap is in the aforesaid position, the handle being movable relative to the guard bar to move the top cap relative to the guard bar for applying a clamping action to a razor blade located therebetween.

5 Claims, 9 Drawing Figures

SAFETY RAZORS

This invention relates to safety razors.

According to the present invention there is provided a safety razor comprising a handle, a guard bar adapted to receive a razor blade thereon, a top cap linked to said guard bar and manually movable into a position in which a razor blade can be trapped between said top cap and said guard bar, a catch for securing said top cap on said guard bar in said position, said catch having a first component on said top cap and a second component which engages with said handle, said first and second components being brought into engagement when said top cap is in said position, said handle being movable relative to said guard bar to move said top cap relative to said guard bar for applying a clamping action to a razor blade located therebetween.

Figure 1:
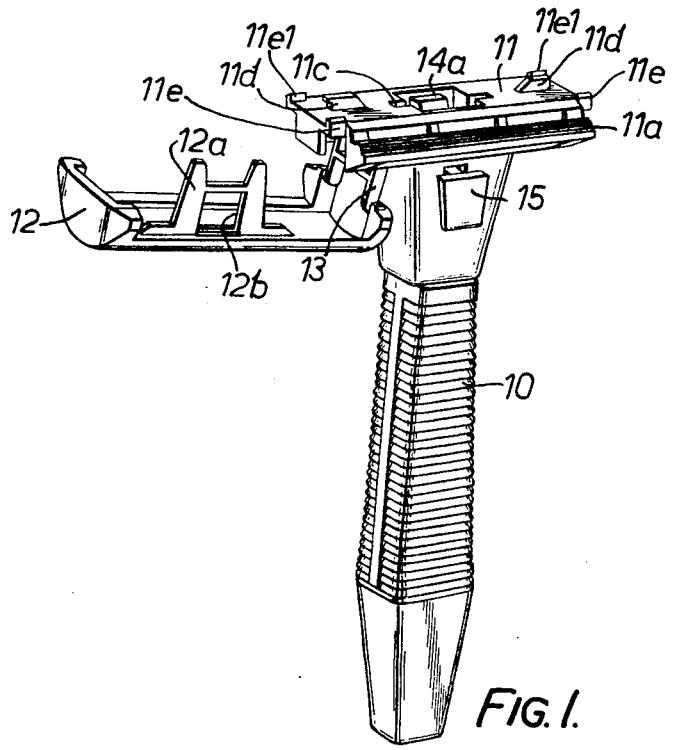
Figure 9:
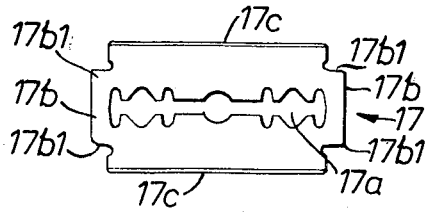
Figure 2:
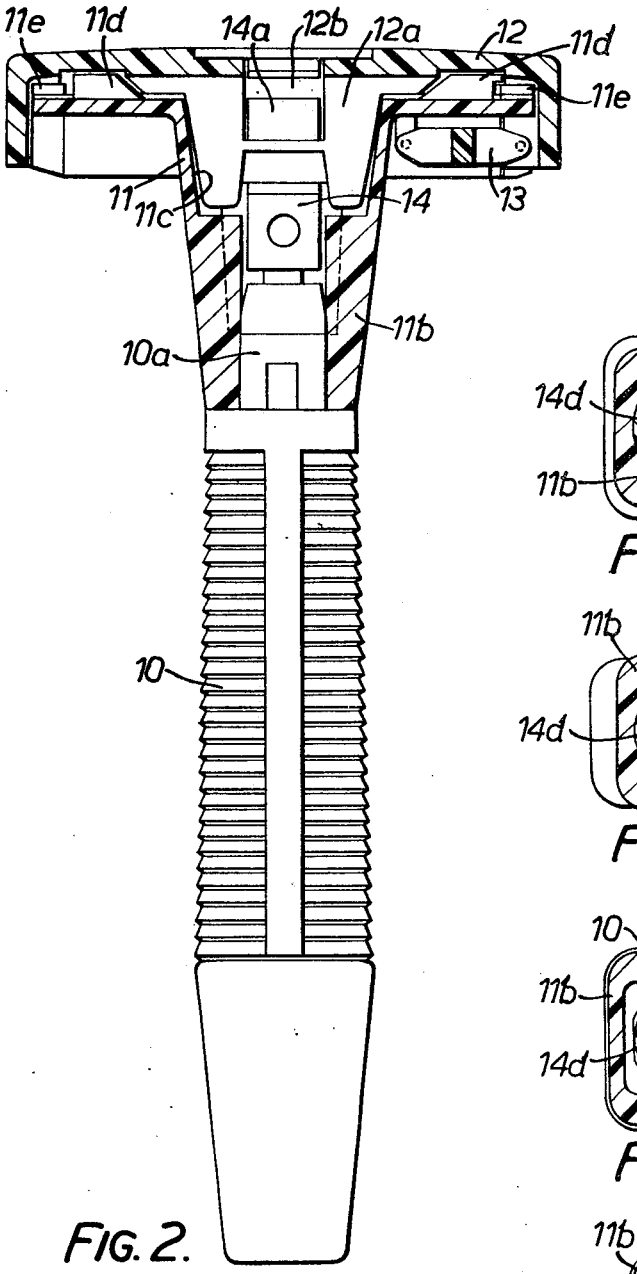
Figure 5:
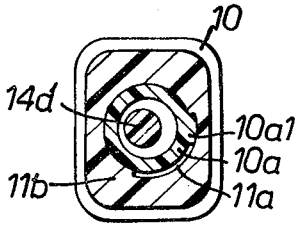
Figure 6:
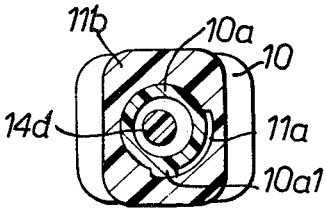
Figure 7:
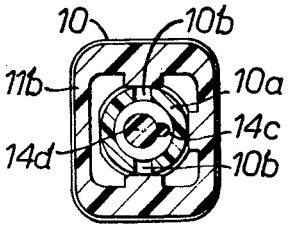
Figure 8:
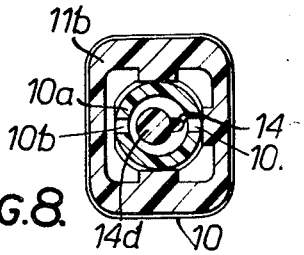
Figure 3:
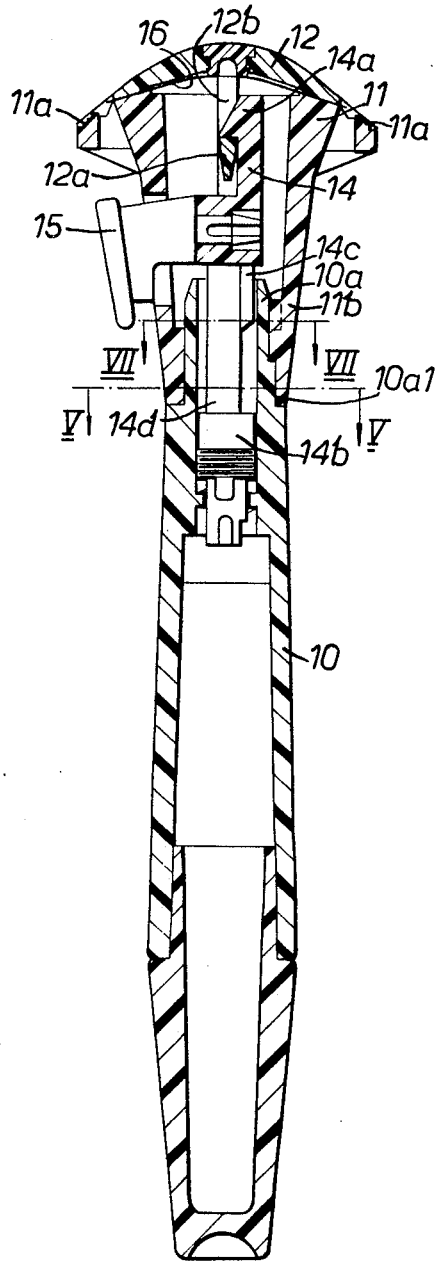
Figure 4:
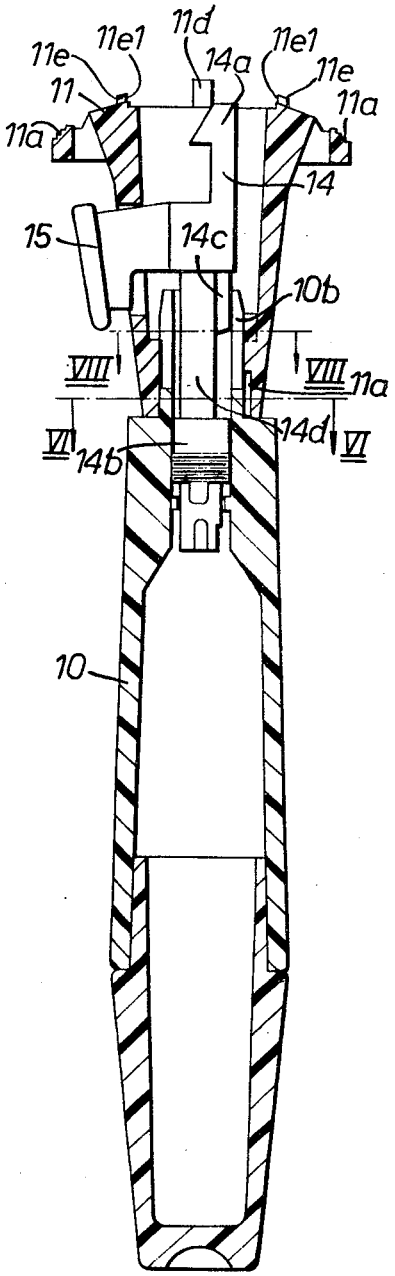

One construction of razor in accordance with the present invention will now be described, by way of example only, with reference to the accompanying drawings in which:

FIG. 1 is a perspective view of this embodiment of razor seen from one side and slightly above, with the top cap in the open position, FIG. 2 is a part-sectional side view of the razor in the locked position, FIG. 3 is a sectional end view of the razor in the locked position, FIG. 4 is a similar view to FIG. 3 but with the top cap (not shown) in the unlocked and open position, FIG. 5 is a section on the line V—V in FIG. 3, FIG. 6 is a section on the line VI—VI in FIG. 4, FIG. 7 is a section on the line VII—VII in FIG. 3, FIG. 8 is a section on the line VIII—VIII in FIG. 4, and FIG. 9 is a plan view of a razor blade.

The razor comprises a handle 10, a guard bar 11 providing two guard surfaces 11*a*, 11*a*, a top cap 12, a toggle 13 linking the guard bar 11 to the top cap 12 to retain the top cap 12 when it is opened by being swung upwardly and to one end of the guard bar 11, a latch arm 14 and a release button 15.

The handle 10 can be rotated about its longitudinal axis, relative to the guard bar 11, through a quarter turn, the two extreme positions being shown in FIG. 3 and 4 respectively. As shown in FIGS. 5 and 6, a key 10*a*1 on the shank 10*a* of the handle 10 prevents movement of the handle 10 beyond these two positions by engagement of the key 10*a*1 with the respective end faces of a keyway 11*a* in the bore of the stem 11*b* of the guard bar 11 in which the shank 10*a* of the handle 10 is accommodated.

A used blade is removed from the upper surface of the guard bar 11 and a new blade placed thereon, when the top cap 12 is in the position shown in FIG. 1. The guard bar 11 has two longitudinal keys 11*d* for engaging the central slot 17*a* in a razor blade 17 (see FIG. 9) in order to give initial location as the blade 17 is laid on the guard bar 11. More precise location of the blade 17 on the guard bar 11 is by four corner pips 11*e* the inner face 11*e*1 (FIG. 4) of each of which engages a respective edge 17*b*1 of one end of the tangs 17*b* on the razor blade 17. The inner faces 11*e*1 of each corner pip 11*e* are inclined at a slight angle to form a tapered lead in, so that when the blade 17 is pressed downwardly by the top cap 12, the tang edges 17*b*1 are brought into firm engagement with the faces 11*e*1. Because the distance between the tang edges 17*b*1 and the cutting edges 17*c* are controlled during manufacture, such location ensures that the spacing of the cutting edges 17*c* relative to their adjacent guard surfaces 11*a* lies within limits which are closer than would be possible if the location was dependent only upon the engagement of the central slot 17*a* with the keys 11*d*. Thereafter the top cap 12 is hinged over and downwardly and is snapped shut, the toggle 13 being designed to allow the top cap 12 to adopt a parallel attitude with respect to the guard bar 11 at closure, thereby ensuring uniform clamping along the length of the blade 16 (FIG. 3). In the course of this movement a claw 14*a* on the upper end of the latch arm 14 is displaced sideways by the downward movement of a tongue 12*a* depending from the underside of the top cap 12. An intermediate portion 14*d* of the latch arm 14 is eccentric relative to the longitudinal axis of the lower end 14*b* and is sufficiently flexible to permit this sideways displacement of the claw 14*a*. With further downward movement the claw 14*a* is restored due to the resilience of the portion 14*d* and thereafter enters an aperture 12*b* in the tongue 12*a* to secure the top cap 12. A slot 11*c* in the guard bar 11 locates the tongue 12*a* in its downward movement, prior to the engagement with the claw 14*a*, thereby preventing any possible sideways pressure on the blade 16. As shown in FIGS. 1–3, the tongue 12*a* is generally flat and is shaped to stiffen the top cap 12.

To clamp the blade 16, the handle 10 is turned relative to the guard bar 11 from the position shown in FIGS. 1, 4 and 6 to the position shown in FIGS. 2, 3 and 5. The lower end 14*b* of the latch arm 14 is in screw-threaded engagement with the bore of the handle 10 and, because the latch arm 14 is prevented from rotating by the release button 15, the quarter turn of the handle 10 draws the latch arm 14 downwards. Due to the engagement of the claw 14*a* in the aperture 12*b* in the tongue 12*a*, this downward movement clamps the blade 16 on the guard bar 11.

The rotation of the handle 10 also locks the release button 15 because, as seen in FIGS. 3 and 7, a key 14*c* is provided on the latch arm 14 which, in the locked position, abuts the periphery of the bore in the shank 10*a* of the handle 10. When the top cap 12 is to be released the handle must be turned to the position shown in FIGS. 1, 4 and 6 and the release button 15 can then be depressed because the key 14*c* is now aligned with, and can enter, a slot 10*b* in the shank 10*a* of the handle 10, as seen in FIG. 8, thereby moving the claw 14*a* out of the aperture 12*b* in the latch tongue 12*a* to free the top cap 12.

The handle 10 is preferably non-circular more readily to distinguish the locked position of the handle 10 from the unlocked position.

I claim:

1. A safety razor comprising a guard bar, said guard bar having two guard surfaces on opposite sides of the guard bar, said guard bar further having an upper razor blade receiving surface and an under surface with a stem portion depending centrally from said under surface, a top cap, said top cap having an upper surface, an under surface and a first position in which the under surface of said top cap covers the upper surface of said guard bar, link means having a first end hinged to said guard bar and a second end hinged to said top cap for swinging said top cap from said first position to a second position in which the upper surface of said guard bar is uncovered, a handle, said handle having a shank at its upper end which shank is rotatably mounted in said guard bar stem portion, a catch for securing said top cap in said first position, said catch having a first component secured to the under surface of said top cap and having a second component within said guard bar stem portion, said first catch component and said second catch component being in catched engagement when said top cap is in said first position, and clamp means including said second catch component being in screw-threaded engagement with said handle and being restrained from rotation by engaging said guard bar stem portion for moving said top cap from said first position to a third position in which said top cap is drawn closer to the upper surface of said guard bar than in said first position upon rotation of said handle in one direction relative to said guard bar stem portion.

2. A safety razor according to claim 1, wherein said first catch component is a generally flat tongue having an aperture therein and said second catch component has a claw adapted to engage in said aperture to secure said catch.

3. A safety razor according to claim 1, wherein said handle is of non-circular cross-section and is rotated about its longitudinal axis through approximately ninety degrees of arc to move said top cap closer to the upper surface of said guard bar.

4. A safety razor according to claim 1, wherein a portion of said second catch component is flexible and said razor includes manually operated release means for urging said second catch component out of engagement with said first catch component when said top cap is in said first position.

5. A safety razor according to claim 4, having blocking means positioned by rotation of said handle in said one direction for preventing operation of said manually operated release means when said top cap is in said third position.

* * * * *